US005482448A

United States Patent [19]

Atwater et al.

[11] Patent Number: 5,482,448

[45] Date of Patent: Jan. 9, 1996

[54] POSITIVE DISPLACEMENT PUMP WITH CONCENTRICALLY ARRANGED RECIPROCATING-ROTATING PISTONS

[76] Inventors: Richard G. Atwater; Kenneth L. Shaw, both of 112 Smith Ave., both of Rockford, Ill. 61107

[21] Appl. No.: 258,092

[22] Filed: Jun. 10, 1994

[51] Int. Cl.[6] ..... F04B 7/04; F04B 39/10

[52] U.S. Cl. ..... 417/492; 417/493; 417/494; 417/500; 417/532

[58] Field of Search ..... 417/492, 493, 417/494, 500, 532

[56] References Cited

U.S. PATENT DOCUMENTS

| | | | |
|---|---|---|---|
| 3,168,872 | 2/1965 | Pinkerton . | |
| 3,447,468 | 1/1968 | Kinne | 417/500 |
| 4,008,003 | 2/1977 | Pinkerton . | |
| 4,941,809 | 7/1990 | Pinkerton . | |
| 5,015,157 | 5/1991 | Pinkerton et al. . | |
| 5,020,980 | 6/1991 | Pinkerton . | |
| 5,044,889 | 9/1991 | Pinkerton . | |
| 5,092,037 | 3/1992 | Pinkerton . | |
| 5,246,354 | 9/1993 | Pardinas | 417/493 |

FOREIGN PATENT DOCUMENTS

| | | | |
|---|---|---|---|
| 2275310 | 8/1994 | United Kingdom | 417/492 |

OTHER PUBLICATIONS

Catalog Pages—R. Hoe & Company Printing Presses, Date unknown—Prior to 1990.

Product Brochure—Fluid Metering, Inc., Feb. 1992.

Magazine Article—"Motion Control Innovations", Designfax, Feb. 1993.

*Primary Examiner*—Richard A. Bertsch

*Assistant Examiner*—Ted Kim

*Attorney, Agent, or Firm*—James T. FitzGibbon

[57] ABSTRACT

A valveless positive displacement pump having pistons that undergo both rotating and reciprocating motion. The assembly comprises a radially outer, ported first cylinder with an axially outer, closed off end, a radially intermediate combination element having outer surfaces serving as a first piston relative to the main cylinder and inner surfaces defining a cylinder for a second piston. The pistons are concentrically arranged, and each reciprocates and rotates within its own cylinder. The piston part of the intermediate element includes a first chordwise relief adjacent its axially inner end and a second chordwise relief in the middle of its shank portion. An access port extends through a wall of the second relief into the interior of the second element. The axially outer ends of first and second pistons each include means for connection to a drive unit with a rotational axis that intersects but is offset from the rotational and reciprocating pistons.

9 Claims, 4 Drawing Sheets

POSITIVE DISPLACEMENT PUMP WITH CONCENTRICALLY ARRANGED RECIPROCATING-ROTATING PISTONS

BACKGROUND OF THE INVENTION

The present invention relates generally to positive displacement pumps, and more particularly, to an improved "valveless" positive displacement pump of the type wherein the pumping action results from a combination of rotating and reciprocating action of a relieved piston within a ported cylinder. Because of the positive displacement action available with such kinds of pumps, they are capable of extremely high precision and are used in a wide variety of applications. Certain of these applications range from supplying ink to enormous printing presses of the type used to print daily newspapers to other applications, which include dispensing products that must be mixed with precision, including pharmaceuticals, chemical products of all kinds, and other liquids.

In general, pumps embodying the concept of a rod-type, relieved piston that reciprocates and rotates within a cylinder are well known. In the basic form, such an arrangement includes two basic parts, including a cylinder having inlet and outlet ports or passages, a rod-like piston that both rotates and reciprocates within the cylinder, and a relief extending chordwise across one end part of the piston so as to form a flat providing a part of a flow passage for liquid to be drawn into and expelled from a closed end pumping chamber.

In operation, the other or remote end of the rod on which the piston is formed includes a connecting rod or pin, one end of which extends radially outwardly from the piston remote end and the other end of which is journaled for universal movement, typically by a rod end or spherical bearing, within an offset leg on a portion of a rotary mechanism. In a typical construction, the rotary or driving mechanism is a crankshaft extending from the armature of an electric motor or the equivalent. This crank mechanism includes a shaft section concentric with the motor, an offsetting cheek or flange and a drive leg extending parallel to the shaft section and typically containing a spherical bearing. In such mechanisms, when the rotational axis of the piston and cylinder are inclined with respect to the rotational axis of the driving element, then the spherical bearing portion of the crank just referred to, upon rotation, will trace a circle in respect to the axis of its own shaft, but will trace an ellipse with respect to the axis of the driven element.

Consequently, the outer diameter end of the connecting rod or pin journalled in the spherical bearing will move through a path which oscillates axially with respect to the axis of the piston or driven element. The total axial excursion is the piston stroke. Pumps of this sort are shown, for example, in U.S. Pat. Nos. 3,168,872, 4,008,003, and 5,020,980.

While pumps of the type illustrated in this application have a number of advantages, including the ability to be tightly sealed, to create substantial static pressures and consequently to deliver very accurately metered quantities of liquid, one significant drawback to such pumps is that, with respect to any one particular pump, the instantaneous output of the pump varies throughout the operating cycle. In one-half of the operating cycle, there is no output, and in other portions, it varies depending on the crank angle. Thus, representing the operation of a typical pump as a sine wave laid out on a horizontal axis, the first 180° or positive half wave form of a trace would represent pump output with respect to crank angle, while the second or negative 180° portion of the sine wave would represent liquid taken in. Thus, it is clear that during one half of its operating cycle, the pump is delivering liquid and on an alternate part of the cycle, the pump is drawing liquid in. Consequently, driven at a constant speed, such a liquid pump not only has an oscillating or pulsating output, but also has no output half the time.

In the past, it has been suggested to overcome this drawback in two ways, neither of which has proven entirely satisfactory. One suggested method has been simply to arrange two pumps in substantially back-to-back relation, one on either side of a motor, placing their crankshafts in a 180°, out-of-phase relationship. Thus, while one piston and cylinder delivers liquid in one portion of its operating cycle, the other pump is drawing liquid in and when the first pump begins to draw in liquid, the second pump would displace or pump liquid out. This arrangement has disadvantages of higher costs and taking up more space. It requires that the liquid handling arrangements, such as porting and manifolding, for example, be doubled. In effect, it is no better than simply having two pump and motor arrangements operated together.

Another approach that has been taken is to have a single, double ended piston, provided with two reliefs, one on each end of the piston, and providing intake and exhaust ports for each one. According to this arrangement, a movement in one direction of the piston would displace liquid and at the same time draw liquid into the other end of the arrangement, in a manner partly analogous to the operation of a two-stroke cycle internal combustion engine.

However, there are significant drawbacks associated with this concept, the main difficulties being the need to provide the second piston with an extension or rod to equalize volume changes per degree of stroke on each end of the piston. This creates space problems and also creates very significant difficulties with sealing the components. One advantage of liquid pumps of this type in the first place is that they run in the presence of a liquid which is usually non-abrasive, and accordingly can use very tight but low friction seals. With the double ended arrangement discussed above, auxiliary seals such as rod wiper seals, O-rings, or the like are needed. This need to introduce auxiliary seals is a serious drawback in the prior art approach just discussed.

Consequently, there has been a need for an improved positive displacement pump of the above type wherein the advantages of a full wave operating cycle could be achieved in a manner which would not require excessive space or unduly large components, which would not require duplication of most of the elements of the drive mechanism and which, furthermore, would not require complex, unwieldy seal mechanisms.

In view of the failure of the prior art to provide a pump having certain of the foregoing advantages and characteristics, it is an object of the present invention to provide an improved positive displacement fluid pump.

Another object of the present invention is to provide a positive displacement fluid pump that will provide a substantially uninterrupted flow of liquid and requires operation only by a single crank mechanism.

A further object of the invention is to provide an improved positive displacement liquid pump able to be driven by a single driving element and yet providing liquid flow during all portions of its operating cycle.

A still further object of the invention is to provide an improved liquid pump that is simple in operation and very compact relative to prior known pumps.

Yet another object of the invention is to provide a positive displacement liquid pump with two pistons, and wherein a portion of one of the pump pistons also serves as a cylinder, and locates a second piston, with both pistons and cylinders being concentrically arranged.

Another object of the invention is to provide a positive displacement fluid pump or motor wherein each of a pair of pistons includes a connecting rod fixed to a piston end and wherein the drive mechanism includes a yoke arrangement with a bearing carded by each opposed leg of a single crank mechanism.

A further object of the invention is to provide a pump and pump drive arrangement which includes a pair of concentrically arranged pistons, one being solid and the other one being hollow, with the solid piston moving within the cylinder formed as a part of the hollow piston.

A still further object of the invention is to provide a positive displacement motor and drive arrangement wherein the pump includes concentrically arranged pistons and cylinders and the drive mechanism includes a rotary shaft portion and a yoke including parallel, spaced apart legs each carrying a bearing journalling an end of a connecting rod extending radially from an associated piston.

Yet another object of the invention is to provide a pump assembly having operating characteristics of two pumps but being formed in a single mechanism and able to be driven by a improved control system which includes a stepping motor arrangement.

Another object of the invention is to provide a pumping arrangement for supplying ink to large printing presses, said arrangement comprising a page pack including a housing receiving the improved ink, plural drive motors mounted on the housing, and appropriate manifolding arranged to permit continuous ink flow from the pumps during their operating cycles.

The foregoing and other objects and advantages of the invention are achieved in practice by providing a compact pump mechanism that includes an outer cylinder sleeve with two inlet and two outlet ports or passages, a combination piston and cylinder received within the outer sleeve and a piston received within the inner cylinder, with the piston and cylinder unit including a pair of chordwise reliefs and the inner cylinder a passage connecting one relief to its interior, and with each of the pistons including a remote end adapted to be journaled for rotation by a drive mechanism normally operated at an axis inclined to the rotational axis of the pistons in the pump unit.

The exact manner in which the foregoing and other objects and advantages of the invention are achieved in practice will become more clearly apparent when reference is made to the following detailed description of the preferred embodiment of the invention set forth by way of example and shown in the accompanying drawings, in which like reference numbers indicate corresponding parts throughout.

DESCRIPTION OF THE PREFERRED EMBODIMENT OF THE INVENTION

While the positive displacement valveless fluid pump of the invention has a very wide variety of applications, one preferred use of the product is in the ink delivery system of large scale printing presses, such as daily newspaper printing presses. In such an application, a plurality of individual pumps are arrayed together within a single housing, and a drive motor is provided for each of the pumps. In a further preferred form, the motors for the pumps are so-called stepping motors. In the preferred arrangement, a digital control circuit provides precisely timed output pulses, and each output pulse results in a very small step of the motor, which typically requires 300 to 400 steps per revolution. Control of each stepping motor is achieved by a keyboard which the operator uses to instruct a dedicated microcomputer in an arrangement whereby individual pump microcomputers communicate with a master computer via serial communications. Typically, a seven-wire bus is provided wherein pulse trains travel throughout the control system and are individually addressed to the appropriate microcomputer. The digital pulse train controls the power supplied to the motors, provides communications or instructions, and advises the microcomputers of the press speed, which regulates the overall output rate of all the pumps. The combination of a set of pumps, motors, their housing and the associated controls are sometimes referred to as a "page pack," i.e., the unit delivers ink to a press that prints in widths that are a multiple of one page. A full-width press may print in widths of four pages. However, while the pumps of the invention are not by any means limited to this kind of application, they possess many advantages when so used. Other applications for the improved liquid pumps are referred to herein.

Figure 1:
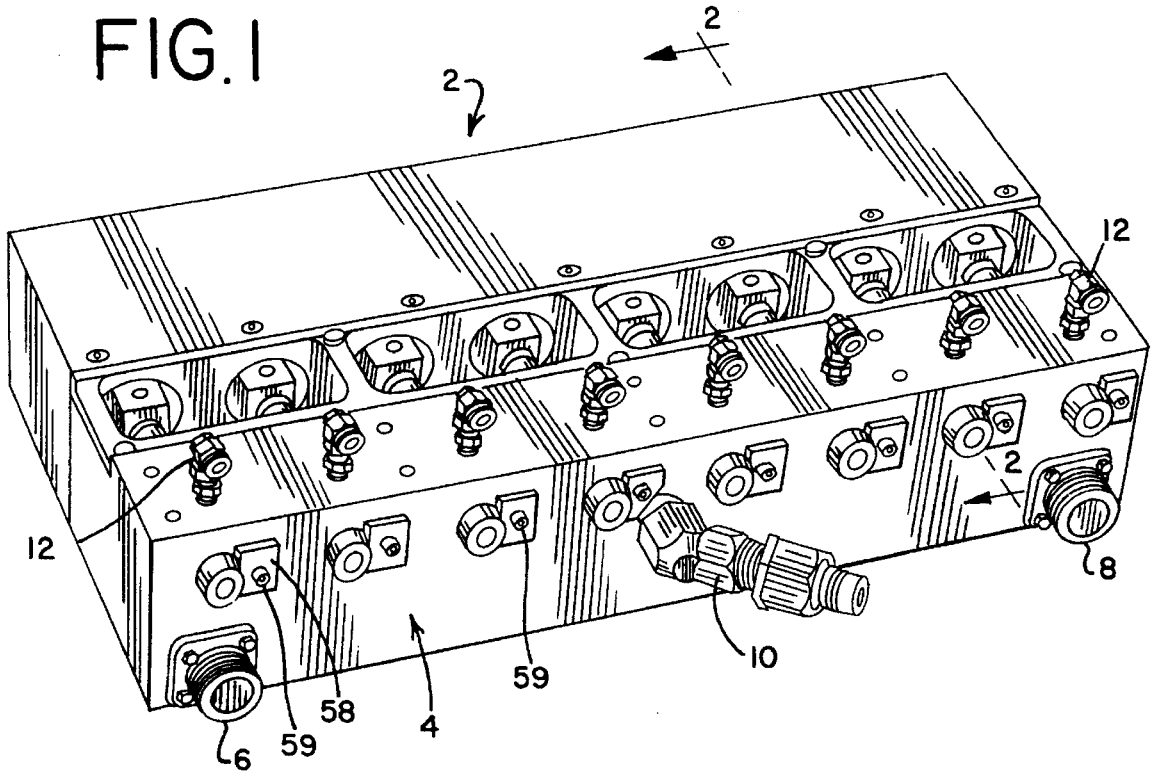
FIG. 1 is a perspective view of an ink delivery assembly incorporating positive displacement pumps made according to the invention, and showing a housing for a plurality of individual motors and pumps, and various fittings used in supplying ink and electric current to the pumps and motors, respectively.

Referring now to FIG. 1, a typical page pack generally designated 2 is shown. This page pack includes a cast or other monolithic housing generally designated 4 having fittings 6, 8 for connection to electrical sources, a liquid inlet fitting 10 which supplies ink to interior passages comprising manifolding within the housing 4. A plurality of individual outlet fittings 12 are provided to supply the ink from the pumps inside the housing to what is termed an orifice plate (not shown), i.e., an area adjacent the inking roller of a press wherein a film or bath or ink is formed for pickup by the inking roller.

Figure 2:
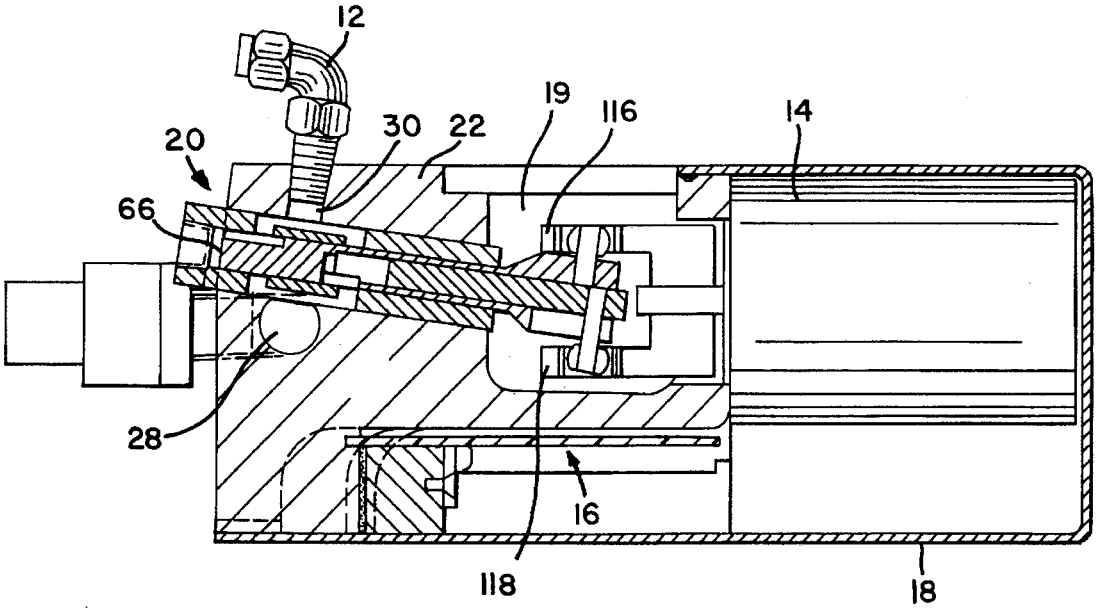
FIG. 2 is a vertical sectional view, taken along lines 2—2 of FIG. 1, and showing certain elements of the novel positive displacement pump unit of the invention.

Referring again to FIGS. 1 and 2, it will be noted that a plurality of individual motors generally designated 14 are fixed in relation to the housing 4 and that a printed circuit-type control board generally designated 16 is secured to another area of the pump housing. A protective sheet metal cover 18 for the circuitboard is secured to the housing, which preferably includes open pockets 19 wherein the connections between the motors 14 and the pumps are made.

Referring again to the drawings in greater detail, and especially to FIGS. 1–6, the principal working portions of the improved positive displacement liquid pump of the invention are shown. Here, a pump assembly generally designated 20 is situated within the housing generally designated 4. Inside the housing 22 are a liquid inlet manifold passage 28 and a liquid outlet passage 30, with the passages 28, 30 being respectively associated with the fittings 10, 12.

Figure 5:
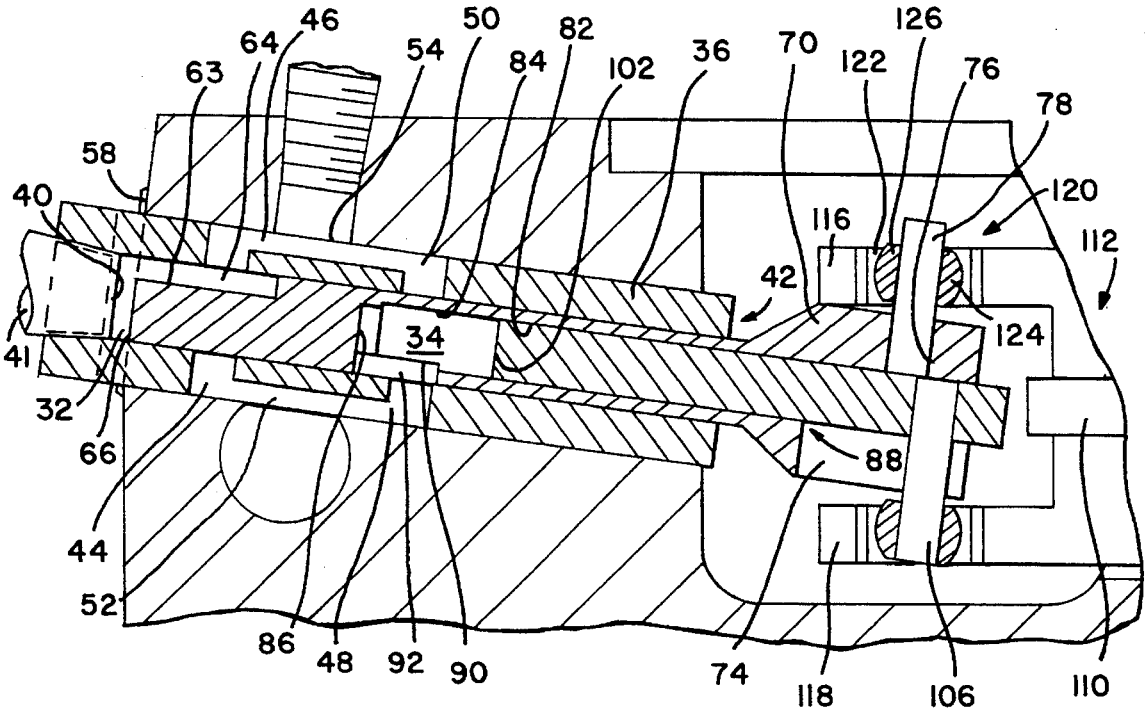
FIG. 5 is an enlarged fragmentary vertical sectional view of the working portions of the novel pump assembly of the invention, showing the pump components in a first position.
Figure 6:
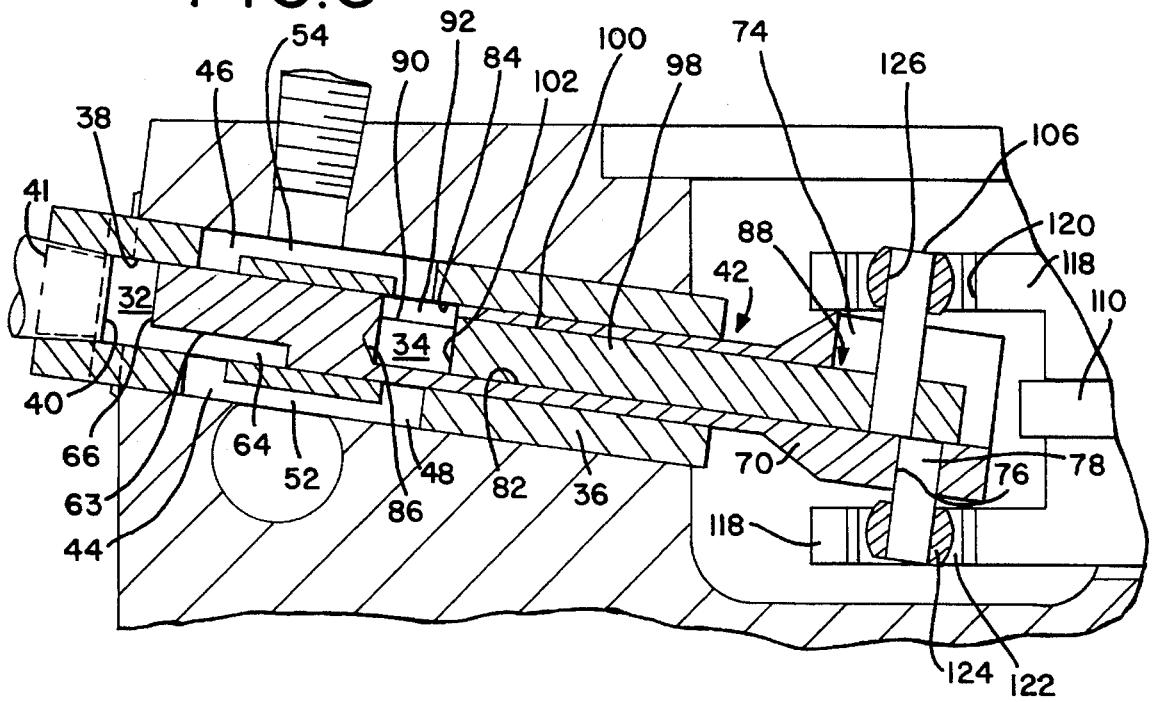
FIG. 6 is a vertical sectional view similar to that of FIG. 5, but showing the pump components in another position of their operating cycle.

According to the invention, the improved pump operates on the principle of providing a first pump chamber 32 best shown in FIGS. 5 and 6, and a second, concentrically arranged but axially offset pump chamber generally designated 34. The first pump chamber 32 lies within an outer cylinder sleeve 36, with such cylinder including an inwardly directed cylindrical wall 38, an inner end face 40 formed on a plug 41 and an open end portion generally designated 42. As used herein, the end adjacent the inner end face 40 may be referred to as the axially inner or proximate end of the cylinder sleeve 36 and the opposite end as the outer, remote or open end 42 of the cylinder.

According to the invention, there are a pair of generally oppositely disposed ports or passages in the outer cylinder sleeve 36 to permit liquid to flow into and out of the first pump chamber 32, namely, a first or axially inner inlet port 44 and a first or axially inner outlet port 46. Preferably the center lines of these ports 44, 46 are disposed opposite each other, i.e., across the bore of the outer cylinder 36. In FIG. 5, they are at the bottom and top, respectively. Thus, the ports extend radially inwardly perpendicular to the center line axis of the cylinder sleeve 36.

Figure 3:
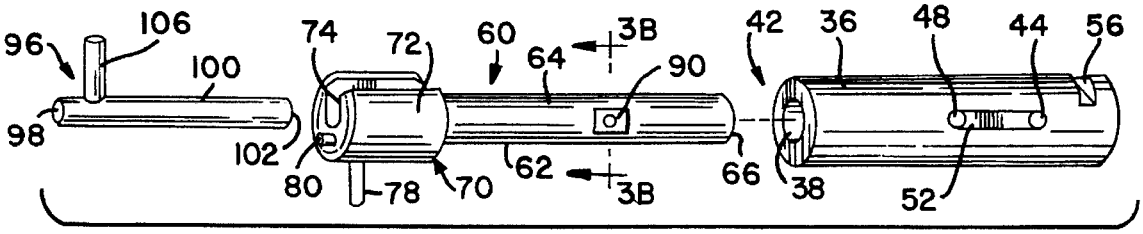
FIG. 3 is an exploded view of three principal components of the positive displacement pump of the invention, a cylinder sleeve, a combination outer piston and cylinder and an inner piston.
Figure 3A:
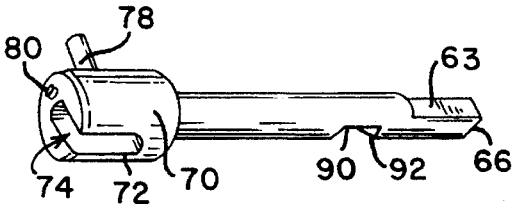
FIG. 3A is a view of one of the components of FIG. 3, showing the same in a different position.
Figure 3B:
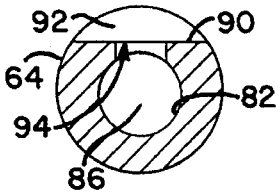
FIG. 3B is a sectional view, taken along lines 3B—3B of FIG. 3 and showing the relief and the flow passage in the inner cylinder in greater detail.
Figure 4:
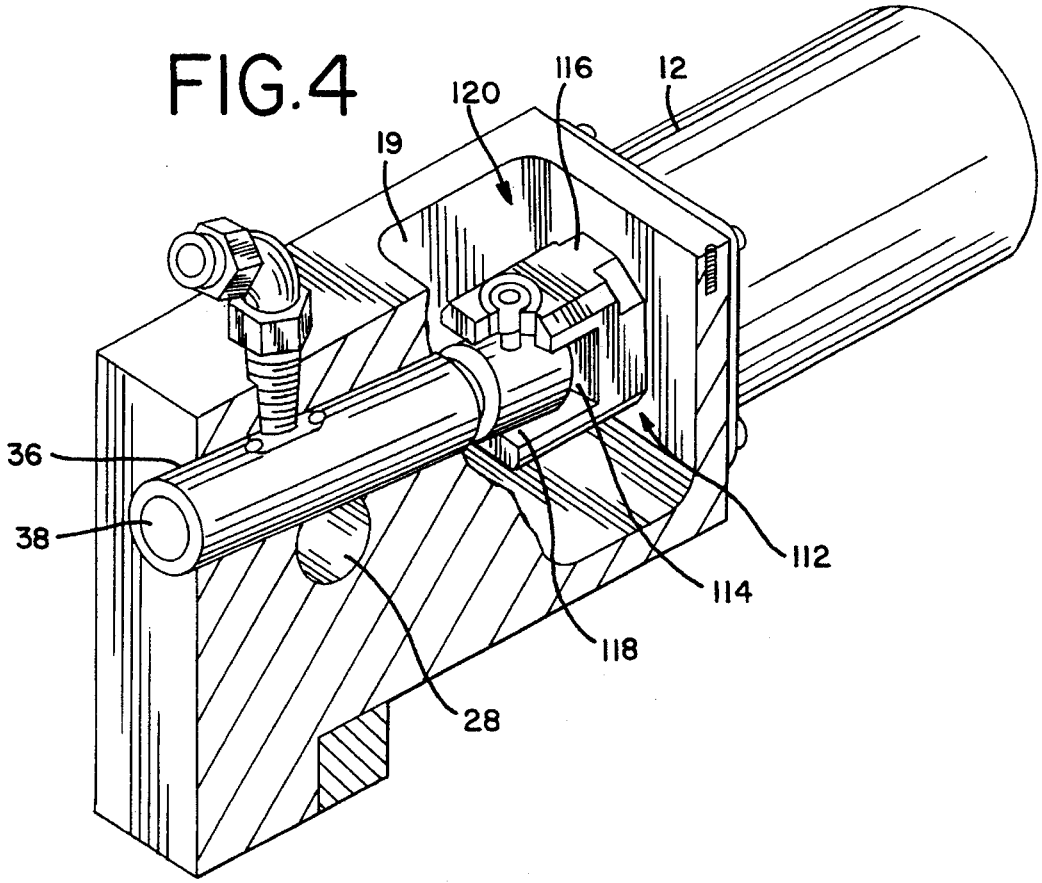
FIG. 4 is a perspective view showing a portion of the pump housing, a motor mounted on the housing, and certain portions of the drive mechanism for the novel pump assembly, with certain portions of the housing shown broken away for clarity.

In the preferred form of apparatus, the outer cylinder 36 also includes a second or axially outer pair of ports, i.e. a second inlet port 48 and a second outlet port 50. The ports 44, 48 are respectively connected to each other by a common inlet passage 52 and the first and second outlet ports 46, 50 are connected by a common outlet passage 54. In FIG. 3, a slot 56 is shown provided for locking the outer cylinder 36 in position within the housing 22. This is preferably done by a locking plate 58 (FIG. 1) held in place by a fastener 59, thus insuring that the cylinder will not rotate or move axially relative to the housing.

According to the invention, another major part of the pump 20 is an intermediate unit generally designated 60 (FIG. 3) and shown to comprise a combination outer piston and inner cylinder body 62. This unit includes a radially outwardly facing cylindrical sidewall 64, and an inner or proximate end face surface 66 (FIGS. 5, 6). The inner end of the piston and cylinder body 62 also includes a chordwise relief 63 combining with the interior of the cylinder wall 38 to define a passage space 64. Thus, because the piston end face 66 never moves rearward enough to uncover the ports 44, 46, liquid flowing through either port 44, 46 into or out of the first pump chamber 32 must flow through the passage space 64 between the relief 63 in the piston body 62 and the outer cylinder sidewall 38.

The outer portion of the piston and cylinder body 62 includes a connecting rod carrier generally designated 70 in the form of an enlarged diameter body 72 having a slot generally designated 74 in one of its cylindrical sidewall surfaces and an opening 76 (FIG. 5)in the other; a first connecting rod 78 extends through this opening 76 and is held in place by a connecting rod set screw 80. Referring again to the piston and cylinder body 62, this element also includes an inner bore generally designated 82 and is shown to include a cylindrical inner sidewall 84 having a closed or inner end portion 86 as well as a rear or open end portion generally designated 88.

The body 62 further includes a chordwise second relief 90 providing a passage space 92 between its surface and the inner surface of the outer cylinder sidewall 38. Moreover, the second chordwise relief 90 is arranged so as to lie axially outwardly of the inner end face portion 86 of the inner bore 82. A radial flow passage generally designated 94 extends from the face of the relief 90 into the closed end portion 86 of the inner bore 82.

A still further essential component of the pump positive displacement pump of the invention is a second or radially inner piston unit generally designated 96. This inner piston unit is in the form of a piston body 98 having a cylindrical sidewall 100 and an inner end face 102. The space between the inner end face 102 and the closed end portion 86 of the inner bore 82 forms the second pump chamber 34 referred to above. The remote or outer end portion of the piston body 98 receives and fixedly positions a radially extending connecting rod 106.

Referring now to the other or driving part of the pump assembly, which drive elements include the motor generally designated 14, the motor has an output shaft 110 forming a part thereof. It will be understood that the shaft 110 conventionally forms an extension of the armature, but that any other suitable connective arrangement between the motor or other prime mover and the shaft is acceptable. At the end of the shaft is a yoke assembly generally designated 112 and shown to include a transverse or radially outwardly extending flange 114, at the respective ends of which are first and second offset legs generally designated 116, 118. In each of the legs is substantially identical, and therefore a detailed description of only one is believed necessary to an understanding of the invention.

Thus, leg 116 includes an opening generally designated 120 which receives a bearing socket 122 which in turn journals a spherical bearing 124. The spherical bearing element 124 includes a center cylindrical bore 126 to receive an end portion of the connecting rod 78. According to the invention, the connecting rod 78 is free to slide radially within the opening 126 and the spherical or rod-end type bearing 124 is free to undergo universal movement within its socket 122, such motions being necessary to achieve the rotary and reciprocating motions that characterize the operation of the inventive pump.

Referring now to the operation of the novel valveless positive displacement pump of the invention, the basic motions undergone by the elements during a working cycle are as follows. For the intake stroke, the piston withdraws from the chamber while the relief is indexed with an inlet passage, with the resulting suction filling the working chamber. By the time the piston begins stroking backwardly towards the closed end of the cylinder, its rotary motion has indexed the relief with the outlet port in the opposite side of the cylinder. This expels the ink or other liquid which was in the chamber and this action continues until the bottom of the stroke is reached, at which point the rotary motion has indexed the relief back into a position where at it is beginning to register with the inlet port again.

In particular, and referring to FIGS. 5 and 6, the connecting rod 78 is rotated and reciprocated, withdrawing the endface 66 of the piston 60 from the end face 40 of the plug, while the chordwise relief 63 is registered with the inlet passage 44 (FIG. 6). Continued motion permits ink to flow from the manifold 28 through the passage 44 and into the working chamber 32 during this time. When the piston has been fully withdrawn and begins stroking forward, the relief 63 comes into registry with the outlet port 46 as the end face 66 of the piston begins to reduce the volume of the chamber 32, thus expelling liquid out the port 44 and through the passage 54, ultimately passing outward through the fitting 12.

According to the invention, at the same time that this action is occurring with the end face 66 and the relief 63 in the near or forward end of the piston and cylinder assembly 60, a similar but exactly opposite phase action is occurring with regard to the second working chamber 34. Here, with the connecting rod 106 being in an appropriate phase relation to the connecting rod 78, as shown in FIG. 6, and further assuming the chamber 34 to have fluid therein, the end face 102 of the piston 98 has moved forward while the relief 90 is in registry with the outlet port 50. This expels ink from the cylinder with the ink also passing through the relief passage 94.

Upon continued rotation, the piston 98 begins withdrawing from the chamber 34, while the relief 92 is registered with the second or axially outer inlet port 48. This draws ink or other liquid from the manifold 28 through the passages 52 and 48 into the working chamber 34. As the rotation of the piston 98 continues, the piston stroke reaches the end of its travel and begins stroking toward the end face 86 of the chamber 34 just as the relief 90 indexes with the outlet port 50 (FIG. 6).

Inasmuch as the reliefs 63, 90 are formed on the same piston and cylinder, there is no chance for the reliefs to register improperly.

As is believed known to those skilled in the art, the angular relation between the driving axis of the yoke 112 and that of the cylinder bore 38 accounts for the reciprocation of the piston. In this connection, it will be noted that when a member such as the yoke 112 is rotated, a given point on one of the yoke legs will trace a circle in relation to the rotational axis of the yoke. However, with relation to an angularly offset axis, an ellipse will be traced, such as on an imaginary cylinder whose axis is inclined with respect to that of the first axis. Consequently, a trace of this movement will be seen as axial motion in respect to the pump. FIGS. 5 and 6 show this action, wherein it is shown that the two pistons, move axially with respect to each another while they are rotating about a common center line axis.

Figure 7:
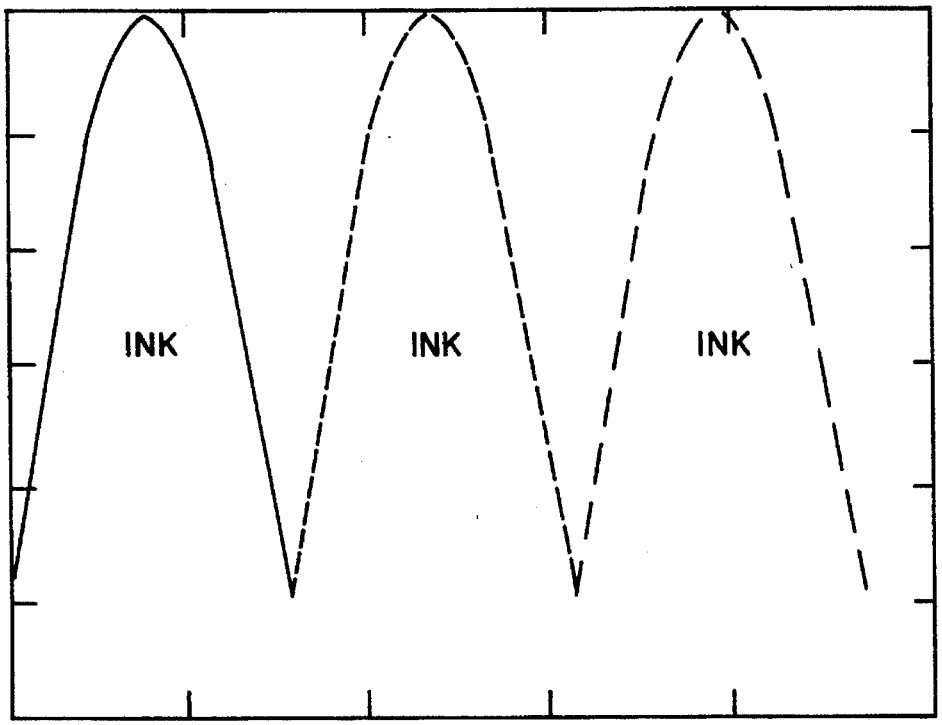
FIG. 7 is a diagram showing the relation of ink flow and crank angle in a pump made according to the invention; and, FIG. 8 is a counterpart diagram of ink flow in a prior art pump.
Figure 8:
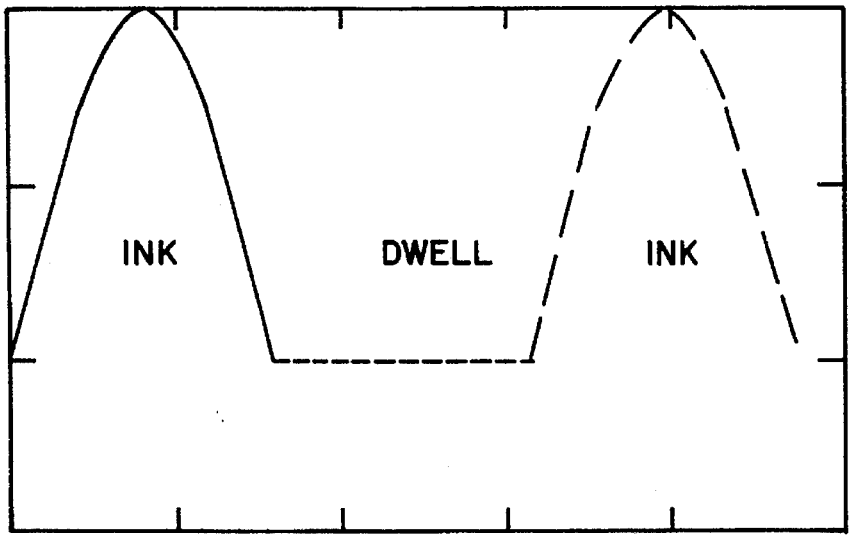
FIG. 8 PRIOR ART

Referring now to FIGS. 7 and 8, there is shown a schematic view of the ink delivery versus crank angle when utilizing the pump of the present invention. Assuming that the horizontal axis of the graph represents degrees of crankshaft rotation and the vertical axis the output of the pump, inasmuch as the reciprocating motion is in effect a sinusoidal movement, a trace of volume delivery will represent a series of half sine waves. Referring again to FIG. 7, it will be noted that there are three lobes, each representing a positive amount of liquid flow, albeit one with a somewhat pulsating character.

Referring to FIG. 8, this shows a flow delivery versus crank angle relation of a prior art pump. In the center of FIG. 8, where the expression "dwell" is shown, reference is made to the position of registry between the relief or fiat on the piston and the exhaust port. When there is no registry of these parts, there is no ink flow and accordingly, prior art pumps develop flow only during one-half of their operating cycle.

In view of the critical nature of the flow which fluid pumps are sometimes required to produce, the ability to be free from lapse or deadspace times is a significant advantage of the present invention.

Whereas, if necessary, it is possible to even out the flow of the operating cycle of the individual pumps by the fine control of motor speed, this is not normally necessary. However, if it is desired to do so, a rapid pulse train may be sent to the stepping motor from the output driver during a portion of the cycle wherein the rate of axial piston movement is low, i.e., near both ends of the stroke, while a reduced pulse rate may be utilized during the center portion of the stroke, i.e. portion of the operating cycle wherein the piston moves most rapidly relative to its rotation.

Referring now to the other aspects of the invention, many liquids may be pumped using the improved pump of the invention. Provided that the substance being pumped is not antagonistic to the materials from which the pump is made, and is not unduly abrasive, virtually any liquid may be advantageously pumped in a precise manner using the concept of the present invention. Engineering plastics as well as high quality steels or other metals may be used to form the components. Pumps of the kind in question do not normally require lubrication, and since they run in the presence of liquids, are able to operate for long periods without undue wear. While the pumps of the invention are advantageous in that they are positive displacement pumps, the concept of the two pistons operating in an axially offset manner along a common rotational and stroking axis is applicable to compressible fluids as well as liquids.

In applications such as a printing press ink flow control referred to herein, the novel pump has proved exceptionally advantageous and satisfactory in use.

In those applications wherein the fluid to be pumped is substantially incompressible, it is important that the relief be constructed and arranged relative to the inlet and outlet ports such that at least a portion of the relief begins to register with such port just as the piston begins to stroke. If the fluid is compressible, this is not a requirement.

The specification and drawings have illustrated a chordwise relief that is of an extremely simple form, namely, a single fiat chordwise cut across the end of the rodlike outer piston. However, the exact configuration of the relief may also be a matter of choice provided that it provides for proper registration with the inlet and exhaust ports. As noted, the inner piston does not require a relief per se; however, the relief is provided on another portion of the structure, i.e., the body forming the outer piston and cylinder. The relief thus serves the function of being respectively in and out of registry with the various ports at desirable portions of the stroke.

In the case of the inner piston and its cylinder, the passage for liquid into and out of the pumping chamber comprises not only the chordwise relief and a portion of the cylinder, but also the radial passage between the two. Accordingly, it will be appreciated that as long as a reciprocable piston can create suction and expulsion for intake and outflow of liquid, the exact porting arrangement is not critical. The preferred embodiment provides an ideal arrangement in that the slot 74 for the inner piston connecting rod lies opposite the position of the outer connecting rod and the slot 74 further insures that the two piston elements will rotate together remain in their 180° out-of-phase relation, while the formation of the reliefs on the same element, i.e., the piston and cylinder, insure the continued alignment of these parts. This arrangement is ideal for a compact, fool-proof mechanism.

The provision of spherical bearings is the preferred manner of permitting the range of movements required of the components in question, i.e., change of angle relative to the yoke and a slight radial movement of the rod relative to the spherical bearing. Clearly, a spline or other telescoping arrangement of rod could be provided if the axial rod movement within the bearing were not desired or permitted for some reason.

In the arrangement shown, the same fluid is taken from a manifold or other single inlet and discharged in a single outlet. However, the common passage connecting the respective pairs of inlet and outlet ports could be eliminated and individual supply and outlet connections to the ports could be made if it were desired to pump two different fluids. In this arrangement, while each of the pumps would have a dead space or zero output dwell time, the advantages of the compact arrangement could still be preserved, however.

While the preferred drive arrangement has been that of an electrically controlled, digital pulse-actuated stepping motor, any form of fixed speed or other kind of variable speed drive could be utilized advantageously with the compact positive displacement pump of the invention. Other variations in certain aspects of the design will also be apparent to those skilled in the art.

In the description given, the yoke serving to drive the opposed connecting rods is in the form of a pair of spaced apart legs affixed to a radial flange. It is to be understood that any suitable means for positioning such connections to the connecting rod ends is appropriate. Thus, the yoke may be in the form of a hollow cylinder or other arrangement adapted to space the connectors to the rod ends at a distance from the center line axis of the drive element.

It will thus be seen that the present invention provides a new and improved positive displacement pump for liquids having a number of advantages and characteristics including those pointed out herein and others which are inherent in the invention. A description of one form of the positive displacement pump of the invention having been illustrated by way of example, it is anticipated that variations and modifications of the described form of apparatus will occur to those skilled in the art and it is anticipated that such variations and changes may be made without departing from the spirit of the invention or the scope of the appended claims.

We claim:

1. An liquid pump, said pump comprising, in combination, an outer cylinder sleeve having a first interior space defined in part by a first cylindrical sidewall and an axially inner end wall, said sleeve having first and second, axially spaced apart inlet passages and first and second, axially spaced apart outlet passages extending from a region exterior to said sleeve to said first interior space, a rotatable and reciprocable assembly received within and in liquid-tight relation to said first interior space, said assembly including outer surfaces defining a first piston having an axially inner end portion and a shank portion, a first relief extending chordwise across said inner end portion of said first piston and a second relief spaced from said first relief and extending chordwise across said shank portion of said first piston, said assembly also including cylindrical inner surfaces defining a second interior space, a second piston reciprocably positioned in said second interior space, wherein said second piston is arranged concentrically within said first piston with said inner end portion of said first piston and said first relief combining with a portion of a first interior end wall and sidewall to define a variable volume first pumping chamber, and with an inner end of said second piston and said second interior space defining a variable volume second pumping chamber, with each of said pistons being rotatable and reciprocable when driven by driving element that is rotatable about an axis that intersects and is at least slightly offset from the rotational axis of said piston and cylinder assembly.

2. A pump as defined in claim 1 wherein said first and second inlet ports and said first and second outlet ports are axially aligned with each other and wherein said first and second chordwise reliefs are positioned on opposite sides of said first piston.

3. A pump as defined in claim 1 wherein said first piston includes a rod carrier of enlarged diameter relative to said first piston diameter, a first connecting rod extending radially outwardly from said carrier, a portion of said rod carrier including a slot therein positioned opposite to said first connecting rod, with said second piston including a second connecting rod extending radially outwardly from said second piston, said second rod being axially movable in use within said slot, whereby said first and second connecting rods remained positioned opposite each other during operation of said pump.

4. A pump as defined in claim 1 wherein said first and second inlet ports are connected to each other by a first passage formed in a portion of said outer cylinder, and wherein said first and second outlet ports are connected to each other by a second passage formed in said outer cylinder.

5. A pump as defined in claim 1 wherein said first cylinder sleeve is removable from a housing adapted to position said cylinder in a fixed orientation relative to liquid supply inlets and outlets in said housing.

6. A pump as defined in claim 3 which further includes a driving element in the form of a drive yoke having oppositely directed, spaced apart legs, with each of said legs carrying a bearing permitting a change in the angular orientation of each of said connecting rods relative to said yoke.

7. A pump as defined in claim 6 wherein said bearings are spherical bearings.

8. In combination, a pump as defined in claim 3, and a drive motor for said pump, said drive motor including an output shaft having a yoke with opposed leg portions, each of said legs containing a bearing permitting angular movement of said connecting rods with respect to said yoke.

9. In a valveless positive displacement pump of the type that includes an outer cylinder sleeve having a closed end, and inlet and outlet ports extending through opposite sides of said sleeve, a first piston which includes a chordwise relief extending across an end portion thereof, and wherein a drive mechanism causes said piston to undergo rotating and reciprocating motions so as to draw in and expel fluid through said ports when said relief is respectively in registry with said inlet and outlet ports, the improvement comprising a closed end cylindrical passage formed in said first piston, a second chordwise relief formed in said first piston and spaced axially apart from said first chordwise relief, a passage extending between said second chordwise relief and the interior of said cylindrical passage, and a second inlet port and a second outlet port extending through opposite sides of said outer cylinder sleeve, with said first piston being movable so as to register said second chordwise relief with said second inlet and outlet ports, and a second piston reciprocably disposed within said cylindrical passage in said first piston so as to form a second chamber between said cylindrical passage and a part of said first piston, wherein said second piston is arranged concentrically within said first piston said second piston, upon reciprocation, drawing fluid into and expelling fluid from said second chamber through said second inlet and outlet ports, respectively.

* * * * *